US010278254B2

(12) United States Patent
Boucher et al.

(10) Patent No.: US 10,278,254 B2
(45) Date of Patent: Apr. 30, 2019

(54) ILLUMINATION SYSTEM WITH COLOR-CHANGING LIGHTS

(71) Applicant: STERNO HOME INC., Vancouver (CA)

(72) Inventors: Frédéric Boucher, Delson (CA); Lucian Hurduc, Ste-Julie (CA); Danny Kam Yin Lai, Hong Kong (CN)

(73) Assignee: STERNO HOME INC., Vancouver (CA)

( * ) Notice: Subject to any disclaimer, the term of this patent is extended or adjusted under 35 U.S.C. 154(b) by 0 days.

(21) Appl. No.: 15/830,417

(22) Filed: Dec. 4, 2017

(65) Prior Publication Data

US 2018/0160503 A1 Jun. 7, 2018

Related U.S. Application Data

(60) Provisional application No. 62/429,123, filed on Dec. 2, 2016.

(51) Int. Cl.
*H05B 33/08* (2006.01)
*H05B 37/02* (2006.01)

(52) U.S. Cl.
CPC ..... *H05B 33/0866* (2013.01); *H05B 37/0272* (2013.01)

(58) Field of Classification Search
CPC ..... H05B 33/083; H05B 33/0803; H05B 33/0809; H05B 33/0815; H05B 33/0827; H05B 33/0842; H05B 33/0821; H05B 33/0857; H05B 33/02; H05B 37/029; H05B 37/0263; Y02B 20/346; F21K 9/00; H02J 9/06; H02J 7/0068
See application file for complete search history.

(56) References Cited

U.S. PATENT DOCUMENTS

| | | | |
|---|---|---|---|
| 5,559,681 | A | 9/1996 | Duarte |
| 6,357,889 | B1 | 3/2002 | Duggal |
| 6,949,894 | B1 | 9/2005 | Sullivan |
| 6,967,448 | B2 | 11/2005 | Morgan |
| 7,196,477 | B2 | 3/2007 | Richmond |
| 7,405,715 | B2 | 7/2008 | Guzman |

(Continued)

*Primary Examiner* — Haissa Philogene
(74) *Attorney, Agent, or Firm* — McAndrews, Held & Malloy, Ltd.

(57) ABSTRACT

An illumination system includes a plurality of distributed units, each having a light source and a light-source controller. The plurality of light sources simultaneously emits a selected type of light. The system also has a primary controller, which includes power-voltage-delivering circuitry and power-sequence-controlling circuitry. The power-voltage-delivering circuitry delivers a LOW or HIGH power voltage to the plurality of distributed units simultaneously. The power-sequence-controlling circuitry causes the power-voltage-delivering circuitry to automatically transition the power voltage between LOW and HIGH in different sequences corresponding to the type of selected light. Each of the plurality of light-source controllers is configured to detect the power voltage provided to the corresponding distributed unit and cause the corresponding light source to emit the selected light type upon receiving the corresponding sequence while the power voltage is HIGH and at a constant voltage.

19 Claims, 21 Drawing Sheets

(56) References Cited

U.S. PATENT DOCUMENTS

| | | | | |
|---|---|---|---|---|
| 7,429,827 | B2 | 9/2008 | Richmond | |
| 7,740,371 | B1 | 6/2010 | Lebens | |
| 8,013,538 | B2 | 9/2011 | Zampini | |
| 8,427,063 | B2 | 4/2013 | Hulett | |
| 8,436,553 | B2 | 5/2013 | Zampini, II | |
| 8,441,196 | B2 | 5/2013 | Liu | |
| 8,979,316 | B2 | 3/2015 | Lee | |
| 8,987,996 | B2 | 3/2015 | Chang | |
| 9,044,056 | B2 | 6/2015 | Chen | |
| 9,362,700 | B2 | 6/2016 | Charlton et al. | |
| 9,370,060 | B2 | 6/2016 | Hiramatu | |
| 2017/0279300 | A1* | 9/2017 | Catalano ..... | H02J 7/0068 |

* cited by examiner

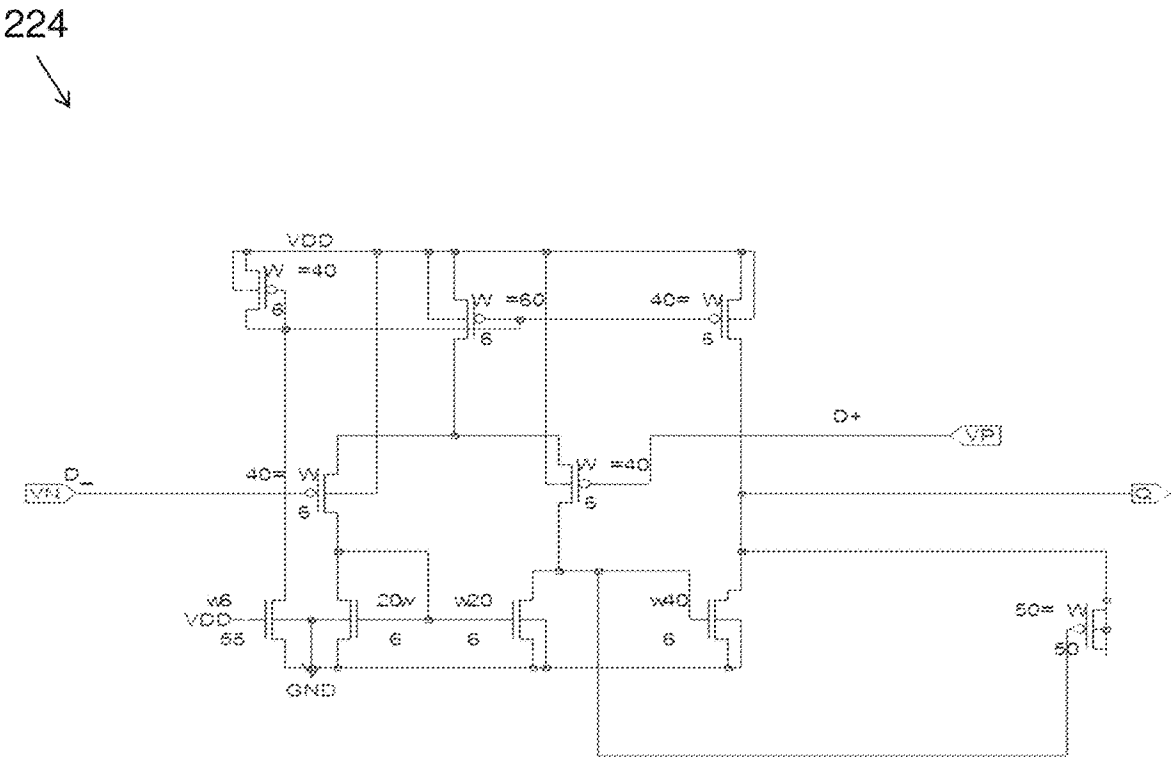
224
D-
VN1
D+
VP1
VDD
GND
VB
VCO
VB
VCO
40=
40=
40=
40=
60=
50=
2DV
VDD
VN
VP
VN
VP
VN
VP

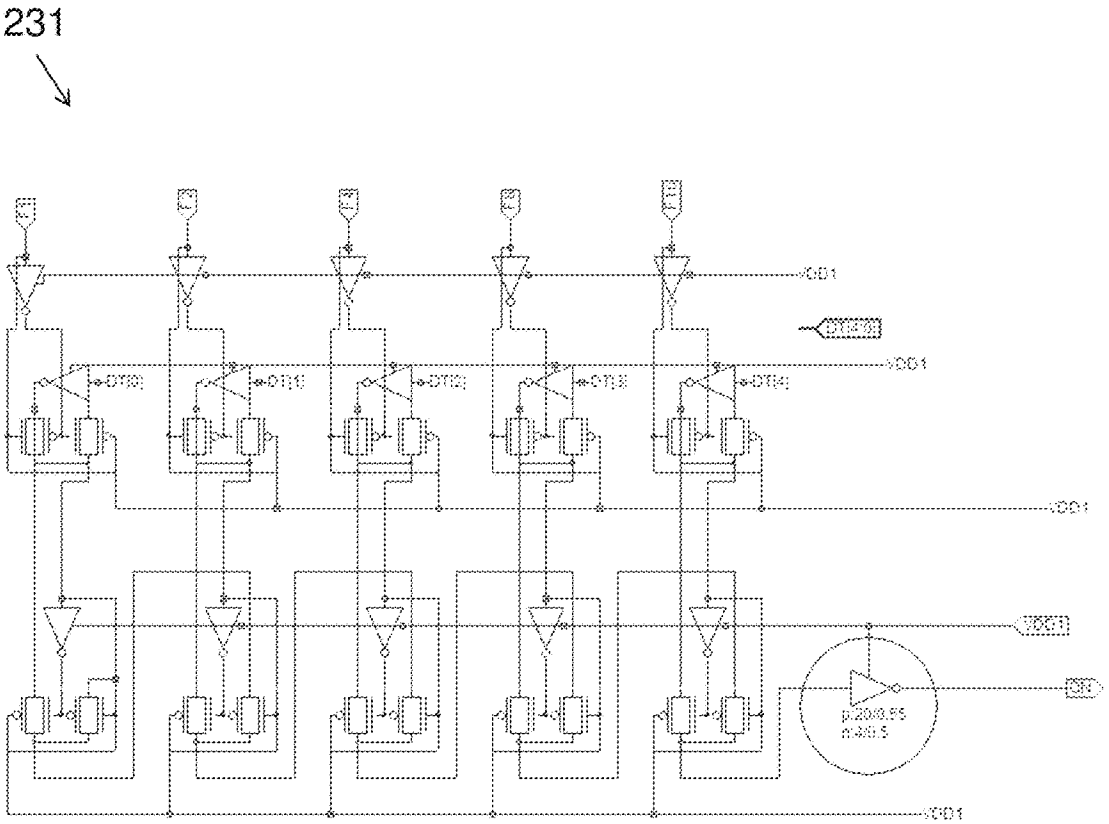
231
E
D
C
B
A
CTRL
CTRL
CTRL
CTRL
CTRL
VDD
VDD
VDD

ILLUMINATION SYSTEM WITH COLOR-CHANGING LIGHTS

CROSS REFERENCE TO RELATED APPLICATIONS

This application claims the benefit of U.S. Prov. Pat. Appl. No. 62/429,123, filed on Dec. 2, 2016, the entirety of which is herein incorporated by reference.

BACKGROUND

Certain inventive techniques herein relate to illumination apparatuses or systems, such as string or rope lights, although they may be applicable to any of a variety of different illumination apparatuses or systems. In particular, certain inventive techniques disclose ways to control the color of a plurality of light sources without having additional conductor(s) to communicate control signal(s).

SUMMARY

According to certain inventive techniques, an illumination system includes a plurality of distributed units. Each of the plurality of distributed units includes a light source and a light-source controller. The plurality of light sources is configured to simultaneously emit a selected type of light (e.g., first, second, or third type). The system also has a primary controller, which includes a voltage converter, power-voltage-delivering circuitry, an input (e.g., a wireless receiver or a local, wired input, such as a switch), and power-sequence-controlling circuitry. The voltage converter is configured to receive a first voltage and output a second voltage. The power-voltage-delivering circuitry is configured to receive the second voltage and deliver a LOW (e.g., zero volts) or HIGH power voltage to the plurality of distributed units simultaneously. The input is configured to receive a selection signal corresponding to one of the selected light types. The power-sequence-controlling circuitry is configured to cause the power-voltage-delivering circuitry to automatically transition the power voltage between LOW and HIGH in different sequences corresponding to the type of selected light. Each of the plurality of light-source controllers is configured to detect the power voltage (e.g., a DC voltage) provided to the corresponding distributed unit, cause the corresponding light source to emit the selected light type upon receiving the corresponding sequence while the power voltage is HIGH and at a constant voltage.

The system may also include a wireless remote control configured to wirelessly transmit the selection signal to the input (e.g., a wireless receiver). The selected type of light may include one of a plurality of predetermined colors and/or predetermined effects. Each of the light-source controllers may not include a processor.

Each of the plurality of light-source controllers may further include: monitoring circuitry configured to detect voltage transitions in the power voltage; command-framing circuitry configured to latch the voltage transitions; and command-interpreting circuitry configured to trigger pulse-width modulation circuitry, wherein the pulse-width modulation circuitry (for example, circuitry that generates a plurality (e.g., 3) of PWM outputs) is configured to control the light source (e.g., three lamps, each controlled by a different PWM output). Each of the plurality of distributed units may include a capacitor configured to provide an operating voltage to a given light-source controller for a predetermined time when the power voltage is LOW.

Each of the plurality of distributed units may be arranged in series, parallel, or a combination thereof. According to one technique: the plurality of distributed units is divided into a plurality of segments including a subset of the plurality of distributed units; each of the plurality of distributed units in the subset is arranged in series with each other; and the plurality of segments is arranged in parallel with each other.

Each of the plurality of light sources may include a plurality of differently-colored light-emitting diodes (LEDs). Each of the plurality of distributed units may include a voltage regulator configured to regulate the power voltage to a regulated voltage provided to the respective light-source controller. Each of the plurality of light-source controllers may be configured to use pulse-width modulation to cause the respective light source to emit the selected type of light.

According to one technique, the power voltage is LOW for a maximum duration during automatic transitioning, the maximum duration is sufficiently short (e.g., less than 10 mS) such that the human eye cannot perceive that the plurality of light sources have stopped emitting light.

Figure 1:
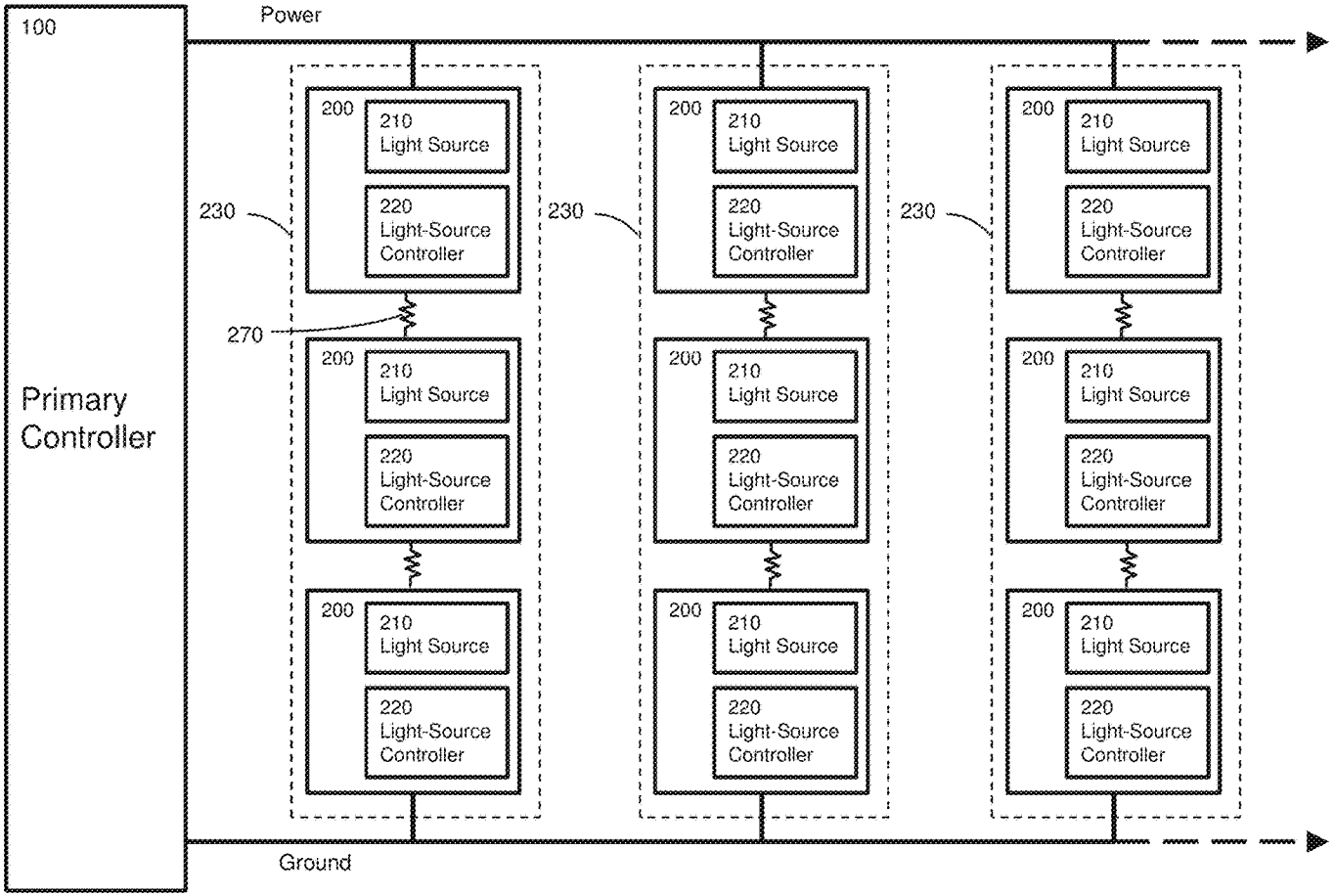
FIG. 1 illustrates a block diagram of an illumination system, according to certain inventive techniques.

The foregoing summary, as well as the following detailed description of certain techniques of the present application, will be better understood when read in conjunction with the appended drawings. For the purposes of illustration, certain techniques are shown in the drawings. It should be understood, however, that the claims are not limited to the arrangements and instrumentality shown in the attached drawings.

DETAILED DESCRIPTION

Some illumination apparatuses (e.g., rope light or string light) have, at each distributed light location, a plurality of lamps (e.g., different color lights, such as red, green, and blue). In some places of this disclosure and in the art, the collection of lamps can be referred to as a light source (even though there are actually three different colors (e.g., three different-colored LEDs). By controlling these lamps differently, different colors or color combinations can be achieved. According to certain inventive techniques, such control can be achieved without having additional "control" conductors. In other words, the colors of the lights can be changed using the two existing conductors—power and common.

According to one inventive technique, at each light location, there is circuitry that controls how the light sources are driven based on a current state. As the state is advanced, the colors change according to a predefined pattern. In addition to the color specified by a given state, behavior or effect of the lights may also be specified—e.g., dimming, swelling, flickering, flashing, variable effects and/or colors (different effects and/or colors to all or a subset of the light sources), random effects and/or colors, etc.

There may also be a capacitor at each light location that can temporarily provide operating power to the local control circuitry (but not necessarily the light sources) when power is momentarily switched off or sufficiently low. This control circuitry may sense that there is no power (or a LOW power voltage) on the power conductor and advances the state. When power is reapplied before the capacitor has discharged too much, the lights will be controlled in a way associated with the new state. If power is removed (or lowered) for a sufficiently long duration that the control circuit can no longer operate (i.e., the capacitor has discharged too much), the control circuit may reset to a default state.

In operation, power sequencing to advance states may occur very rapidly—even so rapidly that the changing color/behavior of the lights may not detectible by the human eye. Sequencing may be performed by a high-speed device, such as a transistor (e.g. MOSFET or BJT). The capacity of the capacitor may determine acceptable sequencing speeds to advance states or return to a default state. For example, interruptions of HIGH power for less than 250 mS (or as low as 30 mS or lower) may cause state advances while an interruption greater than 250 mS may result in the control circuitry returning to the default state.

The control circuitry may or may not include a processor (that uses volatile or nonvolatile memory to track states). According to one technique, a state machine including flip-flops may be used in lieu of a processor.

According to another technique, a message is encoded in power switching. The message may be encoded by the number and/or duration of pulses in the sequence. The control circuitry may receive and decode the message and implement a state or light type accordingly.

It may also be possible to create different colors/effects for different lights in the same string at the same time. For example, if power sequencing is above a certain speed, some control circuits may recognize the interruptions, and some may not. By exploiting this imperfection, different lights may have different colors/behaviors at the same time. Alternatively or additionally, noise may be injected on the power conductor or return to create random-type effects and colors. The randomization technique may be repeated, for example at a given rate (e.g., 0.2, 0.5, 1, 2, 4, or 8 seconds). The rate may also be variable.

Another way to create variable-type effects is to design the control circuitry (e.g., light-source controller 230 discussed below) to detect different transition durations or reset after different transition durations. The light-source control circuitry 230 from light source to light source may be configured differently (e.g., the power-providing capacitor may vary from one control circuitry to the next or the logic may be configured differently). This may enable color and/or effect variation.

Other additional features main include cycling colors and/or effects for all of the light sources at a given rate (or a random or variable rate). It may also be possible to pause cycling and/or variability or randomization. Another possible feature is an automatic shutoff and/or turn-on timer. Such a timer may be selected by a user. A 24 hour period may be divided up, such that the lights are ON for a first duration (e.g., 5 hours or 10 hours) and OFF for a second duration (e.g., 19 hours or 14 hours), and then repeating the cycle. The illumination apparatus may provide visual feedback to the operator that a timer mode has been entered (e.g., blink once for the 5/19 hour timer or twice for the 10/14 hour timer). The timing period may be resettable by the user.

Another possibility is to automatically shut off after a period of time (e.g., 8 hours). Unlike the previously-described mode, there may be no repeating of an ON/OFF timing cycle. The illumination apparatus may provide visual feedback (e.g., three blinks) such that the operator may know such a mode has been entered.

FIG. 1 illustrates an illumination system, according to certain inventive techniques. The illumination system may include a primary controller 100 and a plurality of distributed units 200. Power is provided from the primary controller 100 to the distributed units 200 via a power conductor. The power conductor may supply a voltage (for example, a DC voltage) to the distributed units 200. The power voltage may be, for example, between 170 volts VDC and 350 volt VDC. For example, each distributed unit 200 may require approximately 5 volts (for example, 5 volts±10%). If, for example, there are thirty distributed units 200, then a minimum of 150 VDC may be required to drive them all. The primary controller 100, however, may output a higher voltage (e.g., 170 volts) to account for current-limiting resistors assembled in series with the light sources 210. The primary controller 100 may switch the power LOW and HIGH on the power conductor in a plurality of predetermined sequences.

Each distributed unit 200 may include a light source 210 and a light-source controller 220. The distributed units 200 may be grouped together into a plurality of segments 230. Within a given segment, the distributed units 200 may be in series. The segments 230 may be arranged in parallel with each other. According to this arrangement, the portion of the illumination system containing the distributed units 200 may not have more than three wires in its thickness.

As depicted in FIG. 1, each segment includes a number of distributed units 200. While three are shown for simplicity, a segment 230 may include many more distributed units. A segment 230 may include, for example, thirty distributed units 200 (or more or less, of course). The reference voltage for each distributed unit 200 may be approximately 5 volts. A given segment 230 may see a 150 volt drop across the distributed units 200. The primary controller 100 may output 170 volts. The additional 20 volt drop may be over the resistors 270 assembled in series with the distributed units 200 (see FIG. 6A). These resistances may be limiting the current, for example, to approximately 20 mA through the distributed units 200. The resistances in series in a given segment 230 may be approximately 1 kΩ (combined amongst all resistances in the given segment 230—e.g., 33Ω for each current-limiting resistor 270).

Distributed units 200 may be located at approximately one inch intervals. A strand may contain 4 segments 230 with 30 distributed units 200 each at one inch intervals for a total length of 10 feet, although other lengths/number of segments 230/number of distributed units 200/interval spacings are possible. Strands can be connected together with each other, for example, 10 to 15 strands may be connected together. For example, if a strand is 10 feet, a combination of strands could be 100 up to 150 feet. Multiple strands may be connected in series. In this configuration, all of the distributed units 200 in all of the strands could be powered from the same primary controller 100. The distributed units 200 within a given strand may be arranged in other manners. For example, all of distributed units 200 may be arranged in series. Alternatively, all of the distributed units 200 may be arranged in parallel.

When distributed units 200 are arranged in series, there may be a voltage drop across each distributed unit 200. Therefore, the voltage received by a given unit may be less than the power voltage output by the power-voltage-delivering circuitry 140. Even so, it is to be understood that the power voltage from the power-voltage-delivering circuitry 140 is being delivered to each distributed unit 200, even if that voltage has dropped off from its maximum at a given unit that is not first in the series.

Each light-source controller 220 may control its corresponding light source 210 according to the predetermined sequence of LOW/HIGH transitions on the power conductor. The light-source controller 220 may selectively switch or adjust power provided to the lamp(s) in the light source 210 to control the brightness of the lamp(s).

Figure 5:
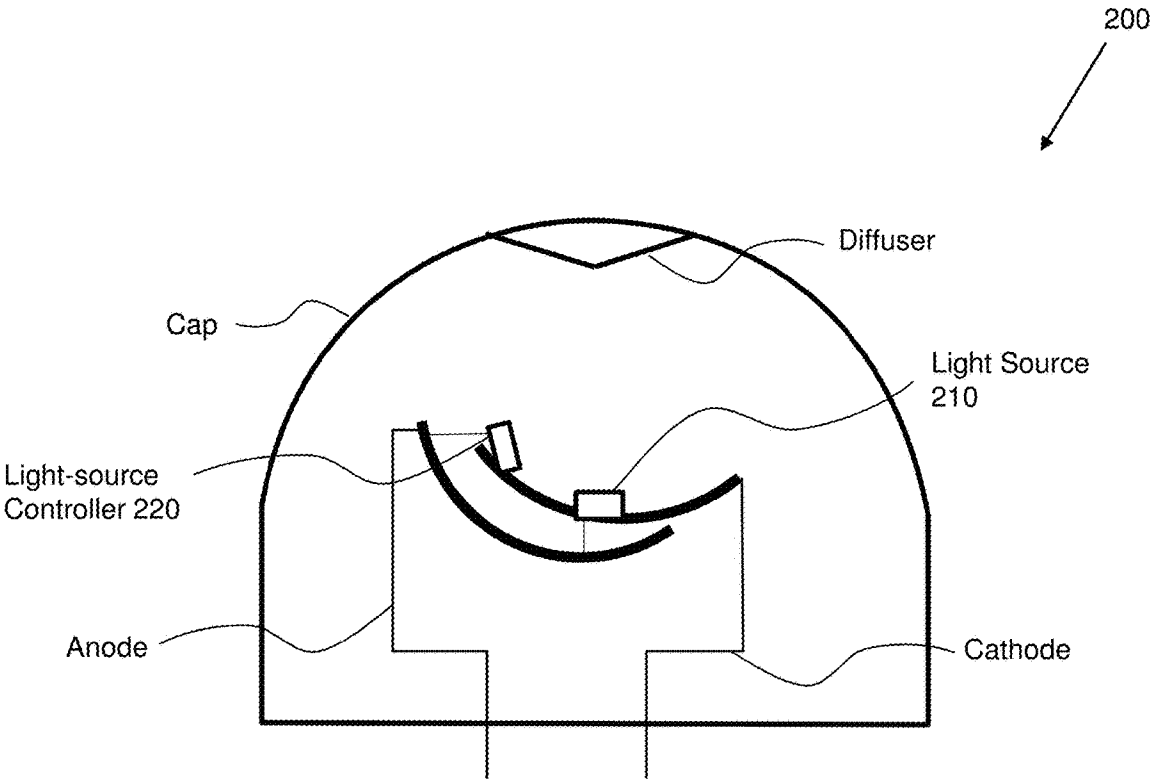
FIG. 5 illustrates an example configuration of a distributed unit including light source and a light-source controller, according to certain inventive techniques.

FIG. 5 illustrates an example configuration of a distributed unit 200 including light source 210 and a light-source controller 220, according to certain inventive techniques. Each distributed unit 200 may contain two chips (e.g., ASICs): (1) a chip including the light-source controller 220; and (2) a chip including the light source 210 (e.g., three the color LEDs). The upper region of the cathode may have a curved (e.g., parabolic) shape to reflect light from the light source 210 located at approximately the center of the curved region of the cathode. To avoid shadows, the light-source controller 220 may be located at the periphery of the curved region of the cathode. The anode end may be positioned near the cathode with a shape to facilitate the electrical connection for each of the chips to the anode (as well as the cathode). The two chips, the cathode end, and the anode end may be located inside a cap (e.g., including an acrylic material). A diffuser may be located in or on an upper region of the cap, and it may serve to mix the light from different LEDs in the light source 210.

Figure 6A:
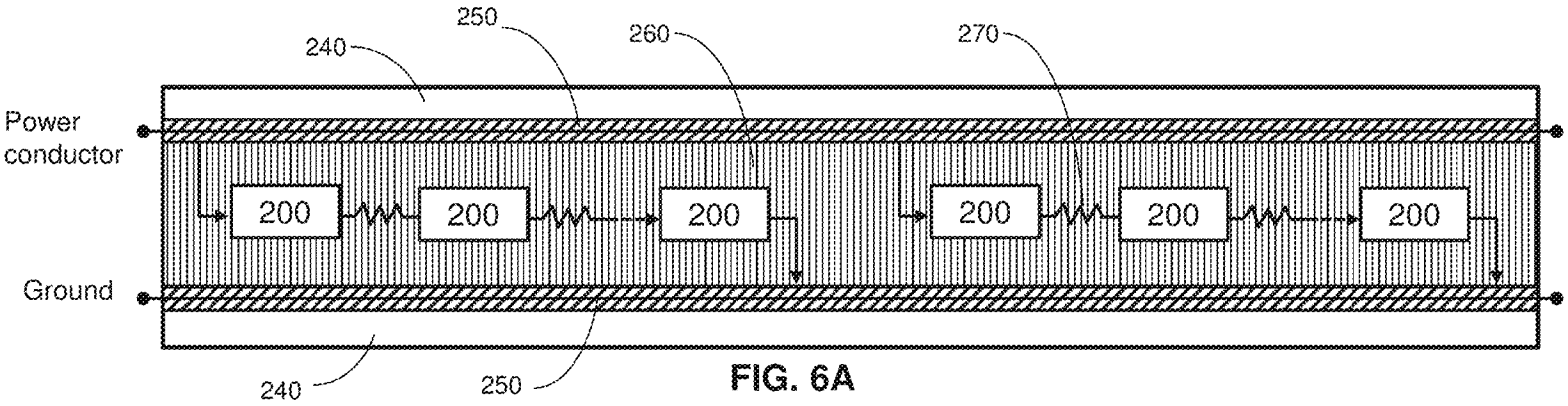
FIG. 6A illustrates a cross-sectional view of the axial dimension of a light strand including a plurality of distributed units, according to certain inventive techniques.
Figure 6B:
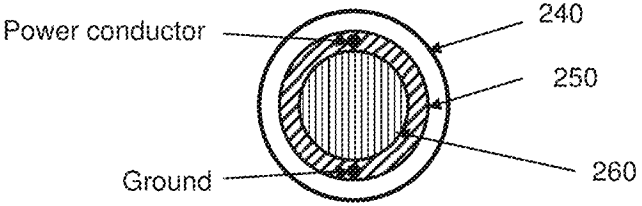
FIG. 6B illustrates a cross-sectional view of the radial dimension of a light strand including a plurality of distributed units, according to certain inventive techniques.

FIG. 6A illustrates a cross-sectional view of the axial dimension of a light strand including a plurality of distributed units 200, according to certain inventive techniques. FIG. 6B illustrates a cross-sectional view of the radial dimension of the light strand including a plurality of distributed units 200, according to certain inventive techniques. The conductors (e.g., power conductor, ground, and conductors between distributed units 200 and/or segments), distributed units 200, and current-limiting resistors 270 may be located in one or more different tubes (e.g., PVC tubes). The tubes may be electrically insulating. An interior tube 260 may substantially envelop the distributed units 200 and the current-limiting resistors 270 (whether arranged in segments 230 or not), as well as certain conductors. An intermediate tube 250 may substantially surround (along a radial dimension) the interior tube 260, and the intermediate tube 250 may envelop the power and ground conductors. An external tube 240 may substantially surround (along a radial dimension) the intermediate tube 250.

The exterior tube 240 may be connected to connectors at one or both ends of the strand. The primary controller 100 may be connected and/or mated to one end connector of the strand. The circuitry of the primary controller 100 may be enclosed in a casing (e.g., may include a polymer such as ABS). The casing (not shown) may have a connector on one side to make a connection to the light strand and a power cable on the other side to make connection to a power outlet.

When power is delivered through the power conductor, all of the light sources 210 may simultaneously emit a selected type of light. The light type may be communicated to the light-source controllers 220 by a predetermined sequence of switching power voltage on the power conductor. Upon receipt of the sequence, the light-source controllers 220 may control their respective light sources 210 to cause them to emit the selected type of light. A different predetermined sequence may correspond to a different predetermined type of light.

There may be various selected types of light—for example, three or more. Examples of types of light are different light colors and/or different light effects. Examples of light colors include red, pink, purple, white, blue, cyan, or green. Examples of light effects include the light source 210 blinking (for example, in a predetermined pattern), flashing, roaming colors, fading in, fading out, or the like, or any combination thereof. For example, a first type of light could be a static blue light. A second type of light could be a flashing red light. A third type of light could be a static white light. Of course, there are many different possibilities for a given type of light.

Each light source 210 may include a plurality of lamps (for example LEDs) each having a different color. According to one technique, a light source 210 has three LEDs of different colors (for example, red, green, and blue). By adjusting the intensities of the differently-colored lamps, it may be possible to create combined light with numerous possible colors. Each LED may be encapsulated in the same package, or they may be in different packages. The light-source controller 220 may also be encapsulated in the package with the LEDs, or it may be separately packaged.

Figure 2A:
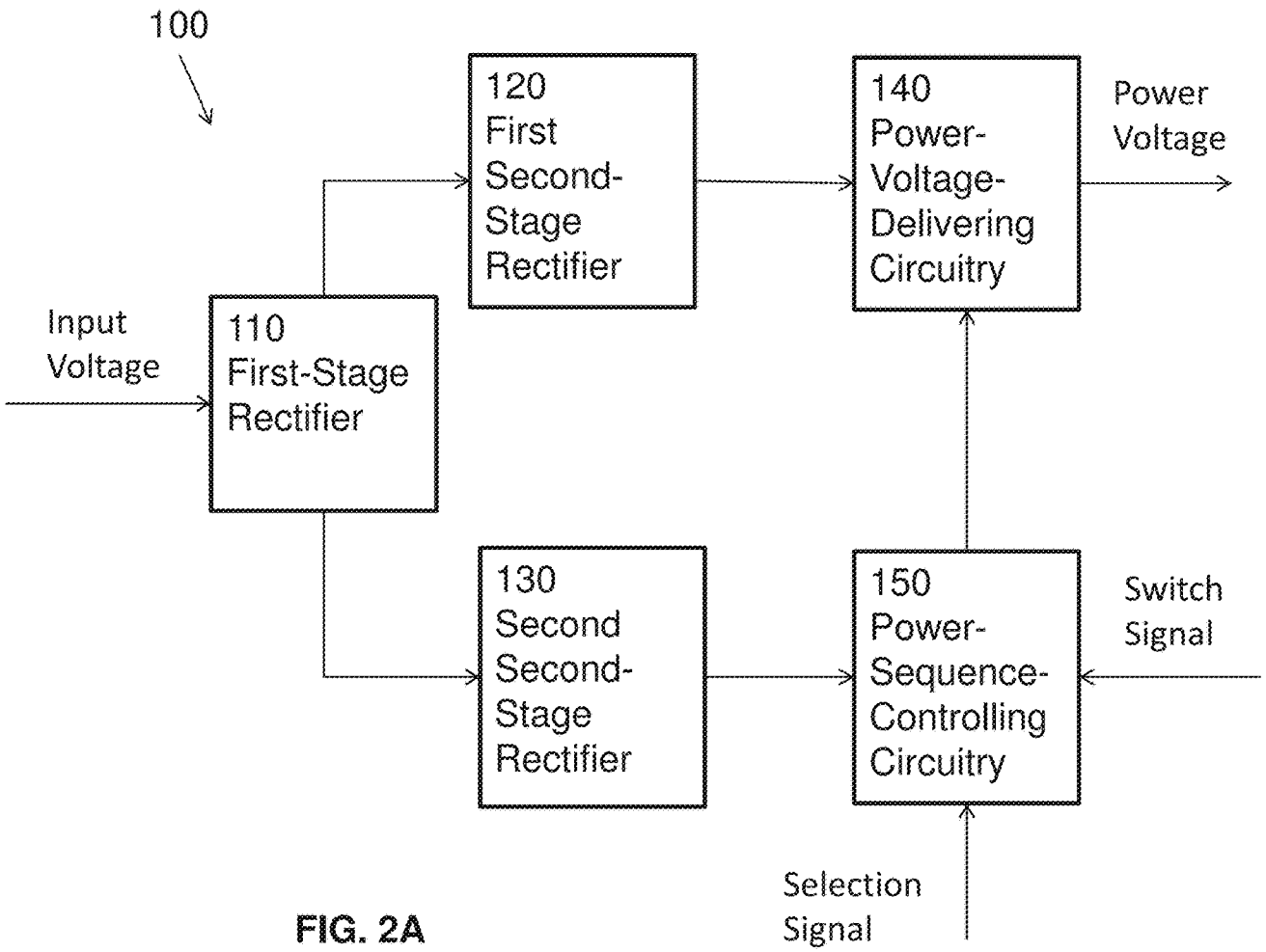
FIG. 2A illustrates a block diagram of a primary controller, according to certain inventive techniques.
Figure 2B:
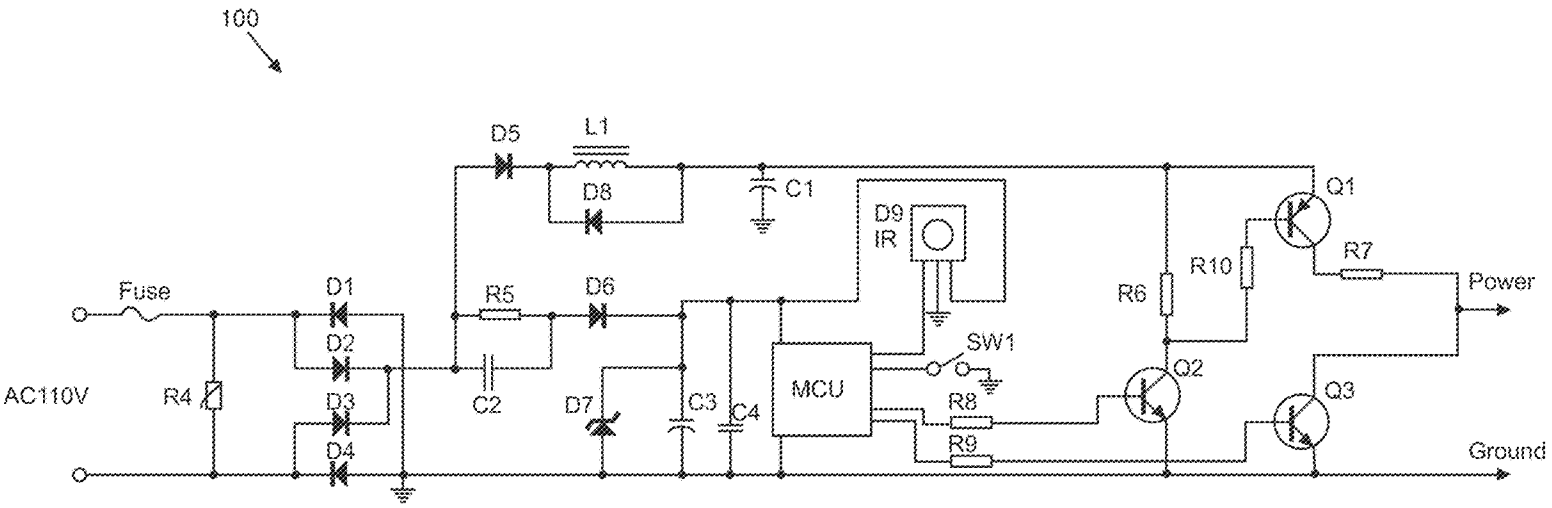
FIG. 2B illustrates a circuit schematic of a primary controller, according to certain inventive techniques.

FIGS. 2A and 2B illustrate the primary controller 100, according to certain inventive techniques. FIG. 2A is a block diagram, whereas FIG. 2B depicts a corresponding exemplary schematic. The primary controller 100 may receive an input voltage—for example, a line voltage such as 110 VAC. A fuse may be provided on the input in case of potentially catastrophic input surges or downstream shorts. A varistor R4 (or a diode, such as a Zener diode (not shown)) may also be implemented to protect against excessive transient voltages. The input voltage may be rectified by a first-stage rectifier 110 (for example, bridge rectifier D1-D4, with 4007-type diodes). The output of the first-stage rectifier 110 may be provided to two different second-stage rectifiers 120 and 130. The first second-stage rectifier 120 may output the power voltage that is ultimately delivered to the distributed units 200. The first second-stage rectifier 120 may include D5 (e.g., 4007-type diode), D8 (e.g., 4007-type diode), L1, and/or C1 (e.g., 200 μF rated up to 400 VDC). The first second-stage rectifier 120 may act as a low pass filter to reduce the voltage variations on the voltage output to the power-voltage-delivering circuitry 140.

The first-stage rectifier 110 and the first second-stage rectifier 120, together, may be a type of voltage converter, in that it receives a first voltage (e.g., 110 VAC) and outputs a second voltage (e.g., 170 VDC). Other circuitry and/or voltages may be possible for a voltage converter. The first second-stage rectifier 120 may provide the second voltage to the power-voltage-delivering circuitry 140.

The power-voltage-delivering circuitry 140 may receive the voltage from the first second-stage rectifier 120 and provide it to the distributed units 200. The power-voltage-delivering circuitry 140 may include the processor, R6-R10, and Q1-Q3. Transistors Q1-Q3 are shown as BJTs, but it may be possible to use MOSFETs as well. The power-voltage-delivering circuitry 140 may be controlled by two outputs on the processor.

Power to the distributed units 200 may be provided by the power-voltage-delivering circuitry 140 when the processor output signal passing through R8 and connected to the base of Q2 goes high (e.g., 5 VDC). This may cause Q2 to be conducting. As a result of Q2 becoming conducting, Q1 may also be conducting. At the same time, the processor output signal passing through the resistance R9 and connected to the base of Q3 may be low (e.g., 0 VDC), thereby causing Q3 to not be conducting. The previous conditions may all be respected, then the power at the output of the primary controller may be high (e.g., 170 VDC).

Power to the distributed units 200 may be discontinued by the power-voltage-delivering circuitry 140 when the output signal of the processor passing through R8 goes low. As a result, Q2 may not be conducting, thereby causing Q1 to not be conducting. At this time, the power conductor voltage may be floating. A short time thereafter (e.g., a few nanoseconds), the processor output signal passing through the resistance R9 and connected to the base of Q3 may go low, thereby causing Q3 to become conducting. The output of the controller may then be pulled down to a low voltage (e.g., 0.7 VDC).

The power-voltage-delivering circuitry 140 may deliver a LOW or HIGH power voltage to the plurality of distributed units 200 simultaneously. Examples of a LOW power voltage may be zero volts or a relatively low voltage level (e.g., 0.7 VDC). Examples of a HIGH power voltage may be (e.g., 170 VDC). The level of the HIGH power voltage may determine how many distributed units 200 can be sufficiently powered. The reference voltage inside each distributed unit may be 5 VDC and 30 distributed units 200 may be assembled in a segment. Furthermore, 4 segments may be assembled in a rope light. The primary controller may be capable of providing the current supplied to 10 rope lights (e.g., a total of 1200 distributed units). It may be possible for the power-voltage-delivering circuitry 140 to vary the HIGH power voltage to adjust the brightness level for each of the light sources 210. Such variance may be controlled by the power-sequence-controlling circuitry 150.

The second second-stage rectifier 130 may provide power (e.g., low-voltage DC power) to the power-sequence-controlling circuitry 150. The second second-stage rectifier 130 may include R5 (e.g., 1 MΩ), C2 (e.g., 1 μF rated up to 400 VDC), D6 (e.g., 4007-type diode), D7 (e.g. 4.7 V Zener), C3 (e.g., 100 μF), and/or C4 (e.g., 0.1 μF). The second-stage rectifier may output power to the processor. The diode D7 may be a Zener diode and may maintain the voltage to a level acceptable for the processor. The diode D6 may be protecting the circuitry from having reverse current if the voltage drops at the output of the first-stage rectifier 110. C4 may act as decoupling capacitor to reduce noise at the processor. C3 may function with the Zener diode to improve voltage stabilization at the processor. R5 and C2 may act together as low pass filter.

The power-sequence-controlling circuitry 150 may cause the power-voltage-delivering circuitry 140 to automatically transition the power voltage between LOW and HIGH in different sequences corresponding to the selected type of light.

The power-sequence-controlling circuitry 150 may include a processor (MCU) and/or related circuitry. The processor may include inputs and/or outputs to accomplish various functions. For example, the processor may receive a switch signal input from SW1, to indicate that power to the distributed units 200 is to be turned on or off. SW1 may be actuated by a user, for example, when it is desired to activate the light system or to turn it OFF altogether.

The power-sequence-controlling circuitry 150 may also have an input that receives a selection signal. The selection signal may be determined by a user interface (not shown). Through the interface, a user may select a given light type, and based on that selection, an appropriate selection signal may be generated and transmitted to the power-sequence-controlling circuitry 150. Possible selection signals include: turn all the light sources 210 ON; turn all the light sources 210 OFF; select a color (e.g., blue, green, purple, etc.) for static display (i.e., constant color at constant brightness); cycle colors of the light sources 210 every X seconds; randomize colors of the light sources 210; vary colors of the light sources 210 among subsets of a strand; randomize colors of the light sources 210 every X seconds; vary colors of the light sources 210 among subsets of a strand; pause color cycling of the light sources 210; pause color randomization of the light sources 210; pause randomization cycling of the light sources 210; enable timer mode(s); enable auto shut-off mode; cause light effects of the light sources 210, such as dim, color roam, flash; randomize light effects of the light sources 210; randomize color and light effects of the light sources 210; vary color and/or light effects of the light sources amongst subsets in a given strand; change repeat rate of light effects to X seconds; increase the value of X; and/or decrease the value of X.

The user interface may be on the illumination apparatus itself. It may also be on a wired or physically tethered component. The user interface may also be on a wireless device (not shown). The wireless device (or remote control) may communicate with the illumination apparatus with infrared light, Bluetooth, WiFi, or the like. In such a case, the primary controller 100 may include a wireless receiver. An example of such a wireless receiver is D9, an infrared photodetector, for use with an infrared remote control. Other types of wireless receivers include Bluetooth, WiFi, or the like. The received selection signal may be communicated to the processor, where it is decoded and control of an appropriate power sequence is initiated by the power-sequence-controlling circuitry 150.

FIGS. 3A, 3B, 3C, 3D, 3E, 3F, 3Ga, 3Gb, 3Gc, 3Gd, 3H, 3I, 3J, 3K, and 3L illustrate a light-source controller 220, according to certain inventive techniques. As depicted, the light-source controller 220 does not include a processor, but it would be possible to implement some or all of the circuitry with a processor, and, as such, would be within the scope of a light-source controller 220. Also, while ground (GND) is depicted in FIGS. 3A-3L, it is understood that this "ground" is actually the output to the next distributed unit 200 in a series, and is not system ground. Only the ground of the last distributed unit 200 may connect to the system ground.

Figure 3A:
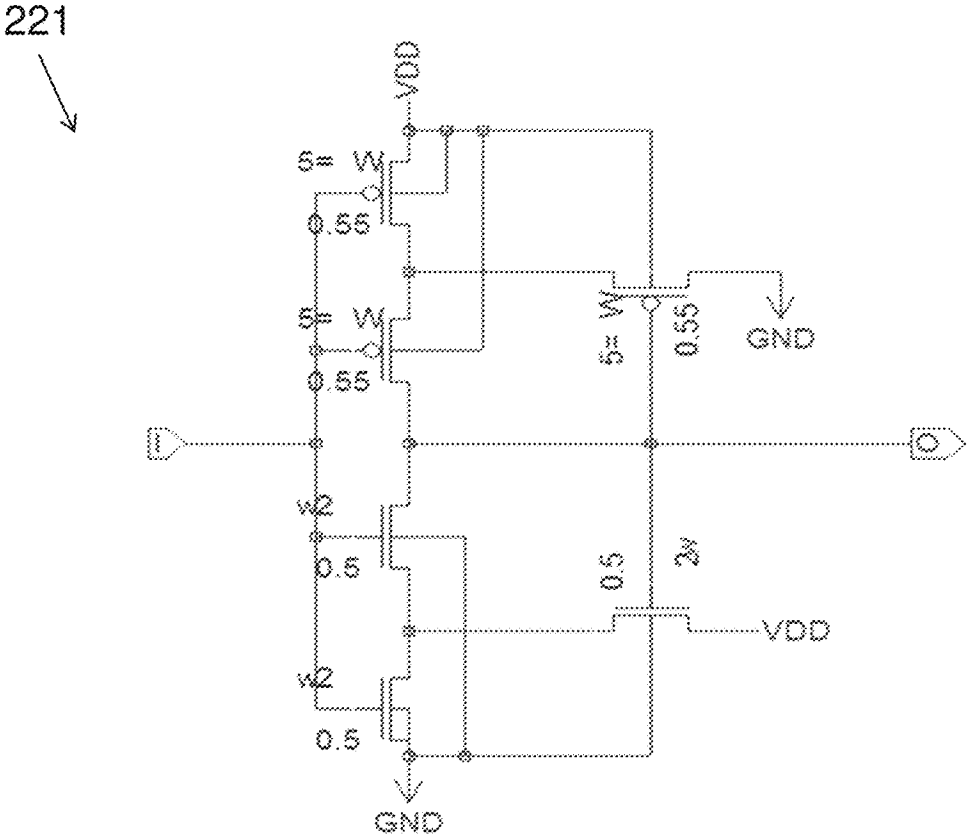
FIG. 3A, 3B, 3C, 3D, 3E, 3F, 3Ga, 3Gb, 3Gc, 3Gd, 3H, 3I, 3J, 3K, and 3L illustrate circuit schematics of a light-source controller, according to certain inventive techniques.
Figure 3B:
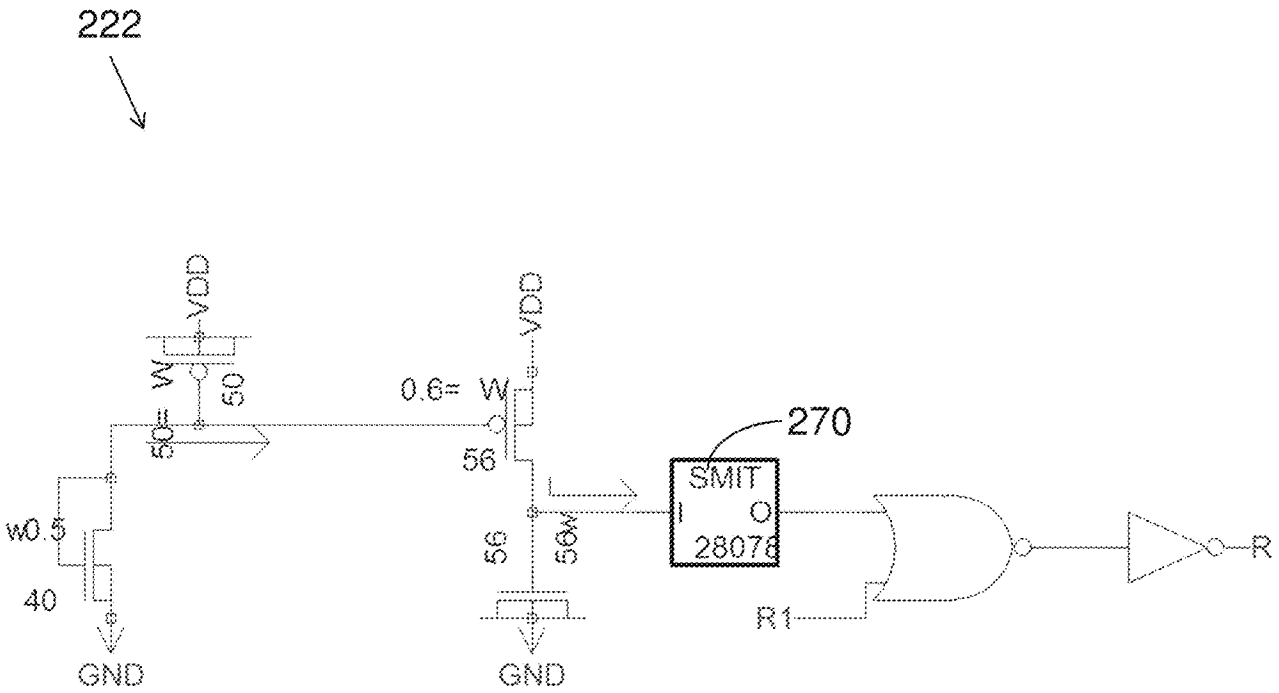
Figure 3C:
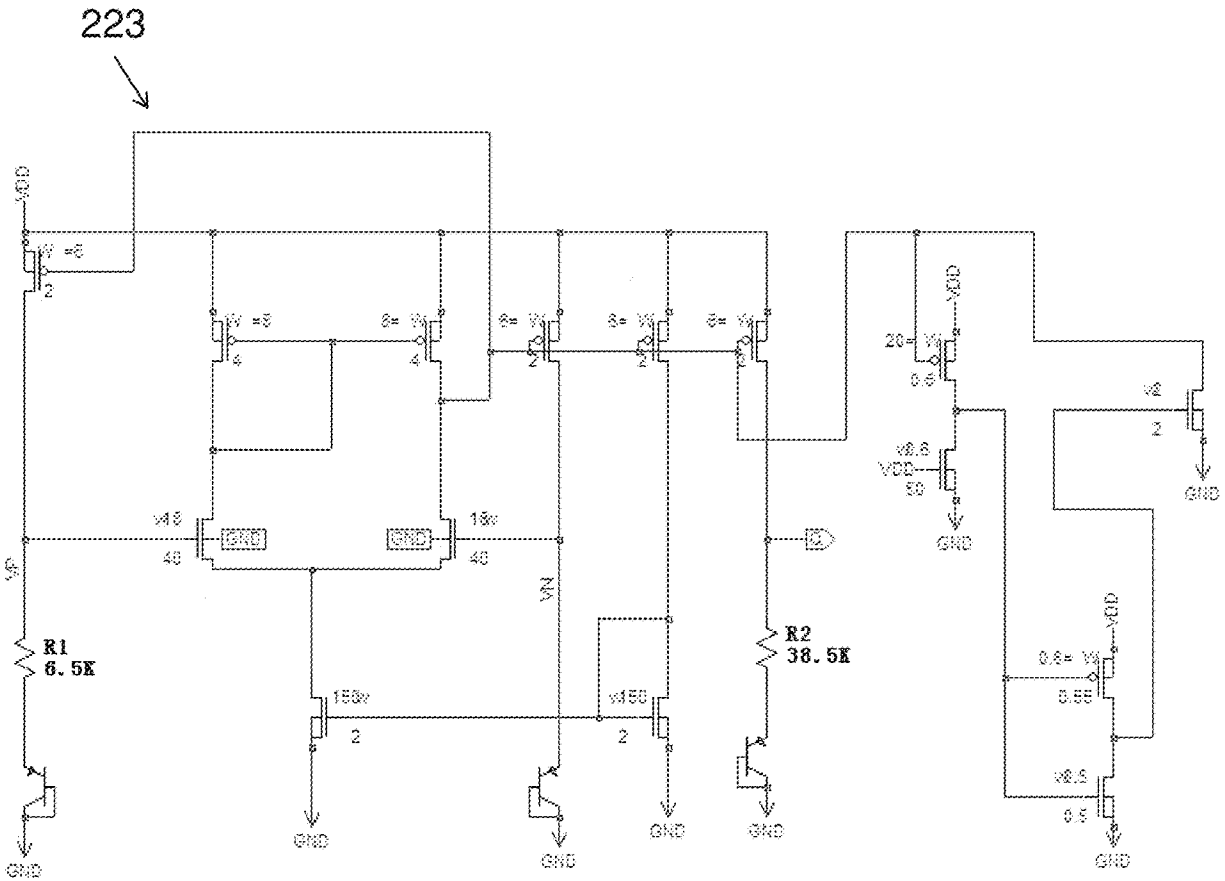
Figure 3E:
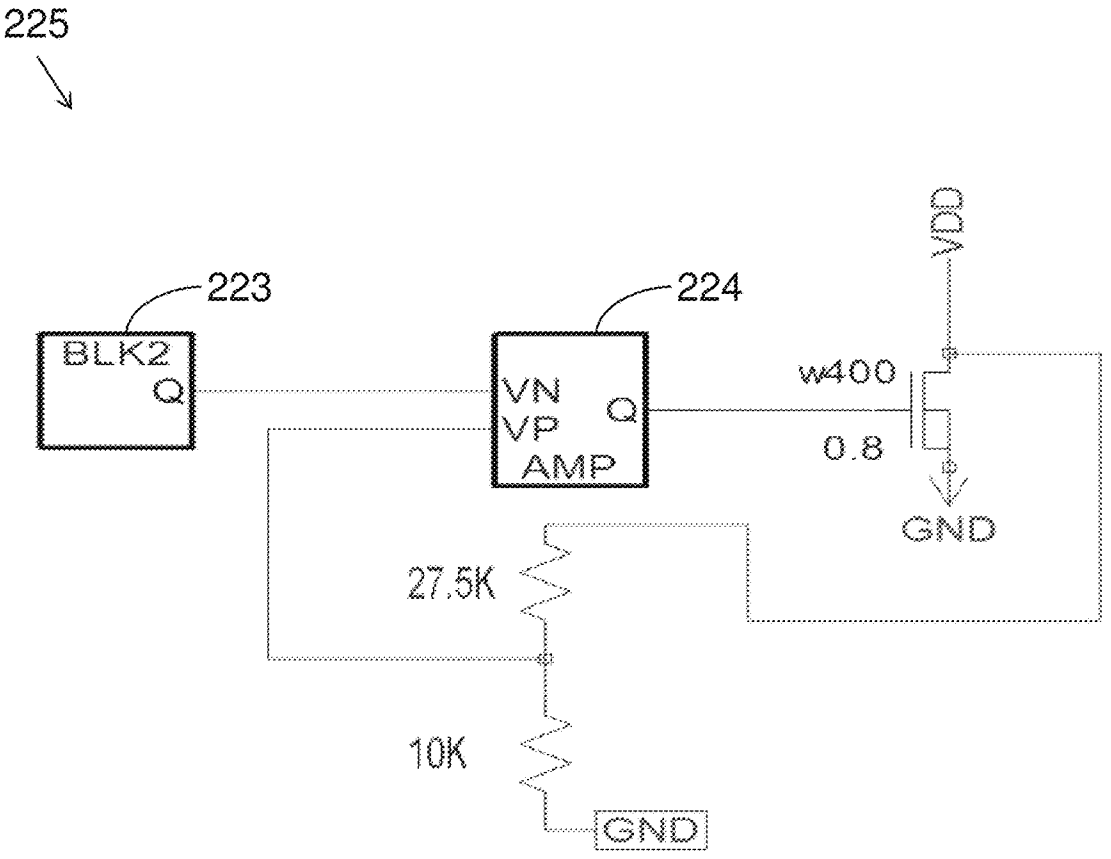
Figure 3F:
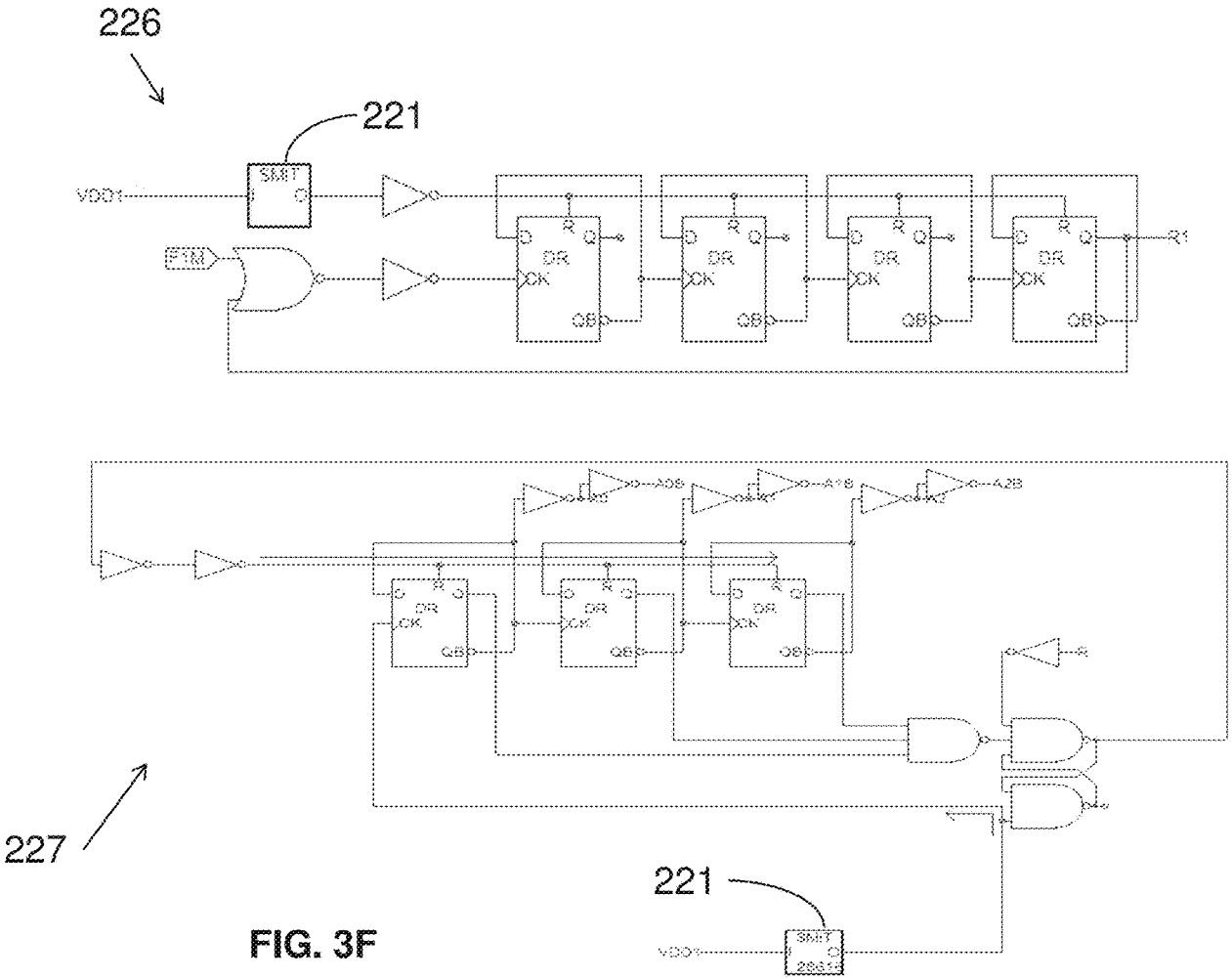
Figure 3G:
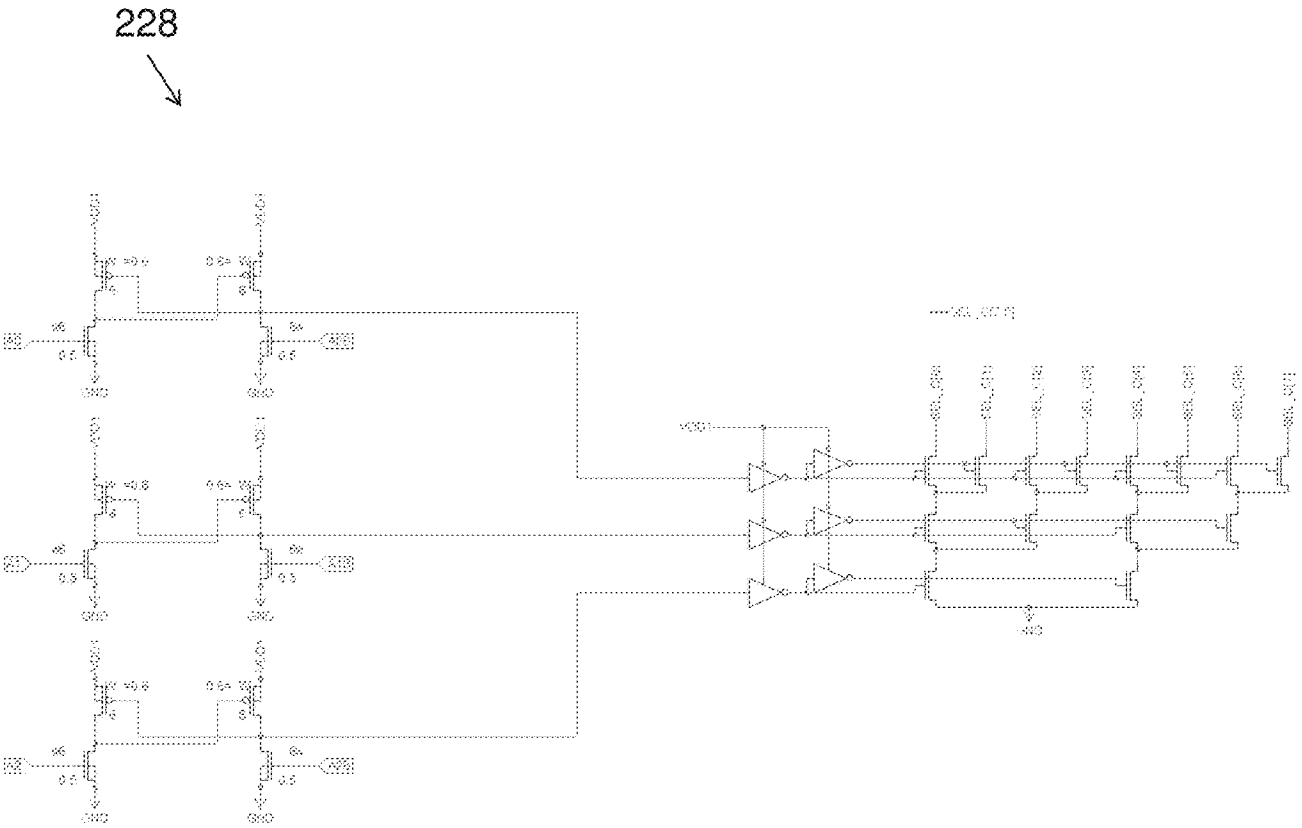
Figure 3G:
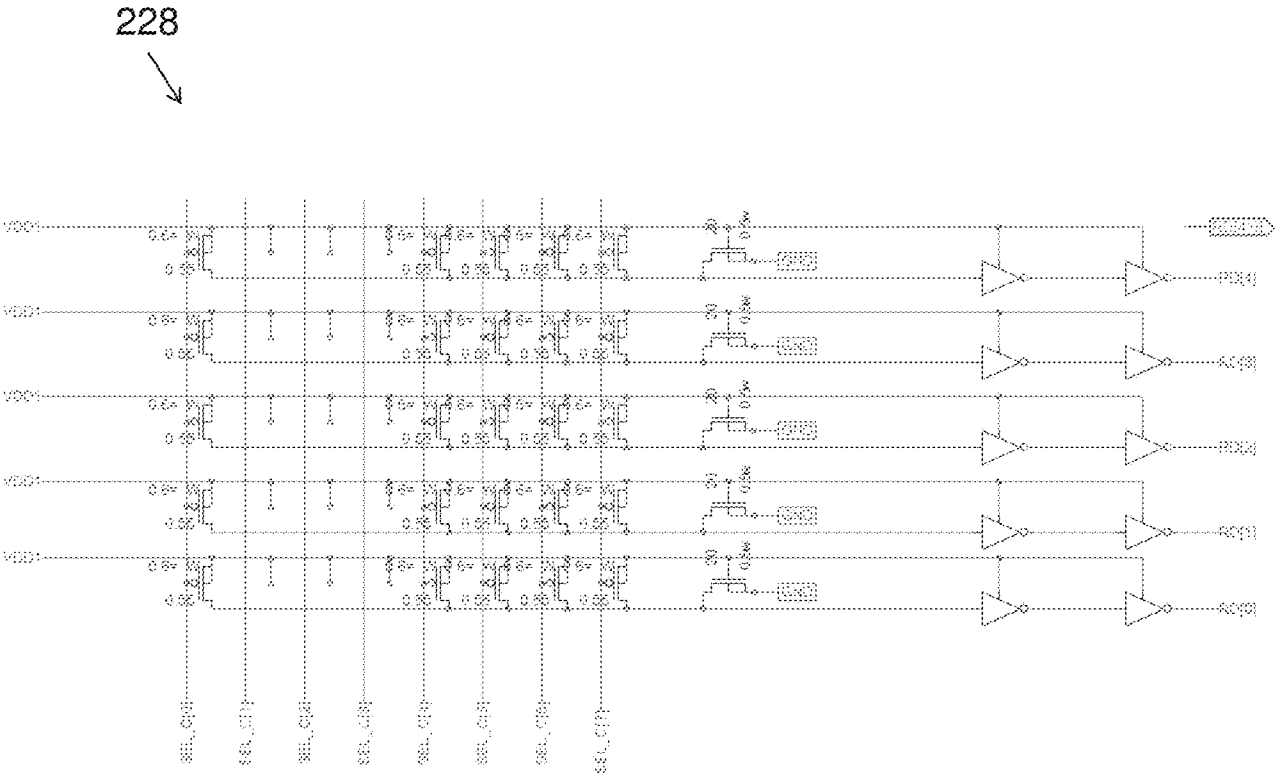
Figure 3G:
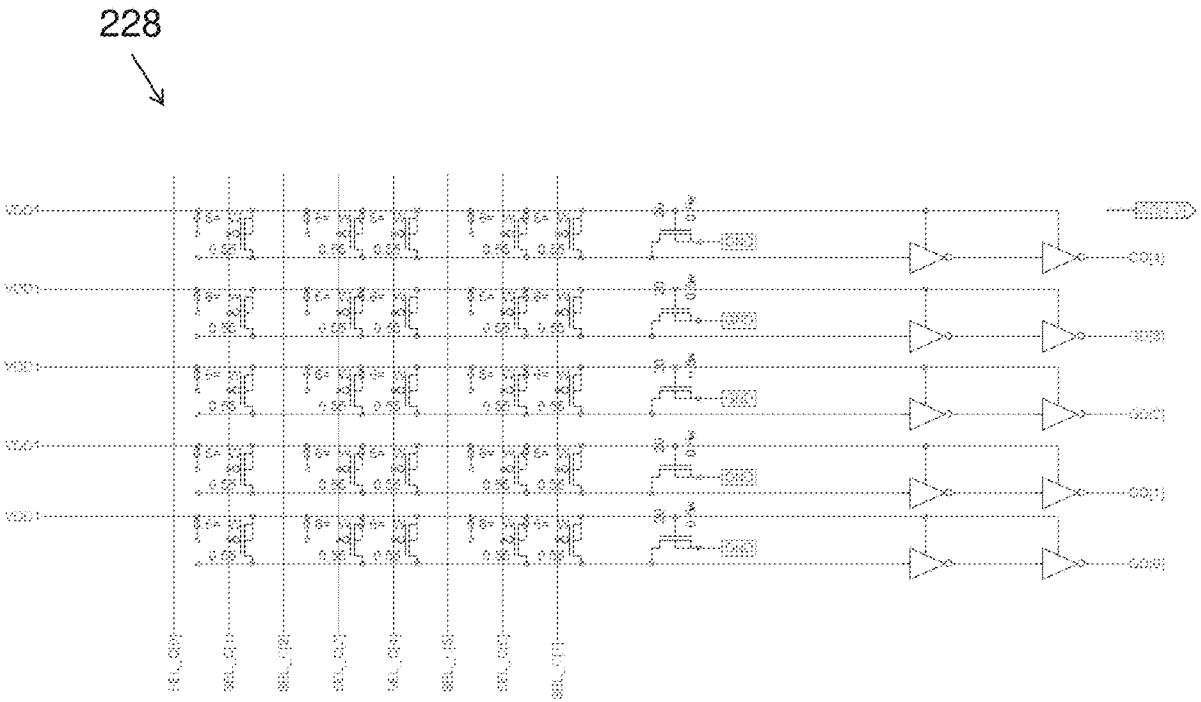
Figure 3G:
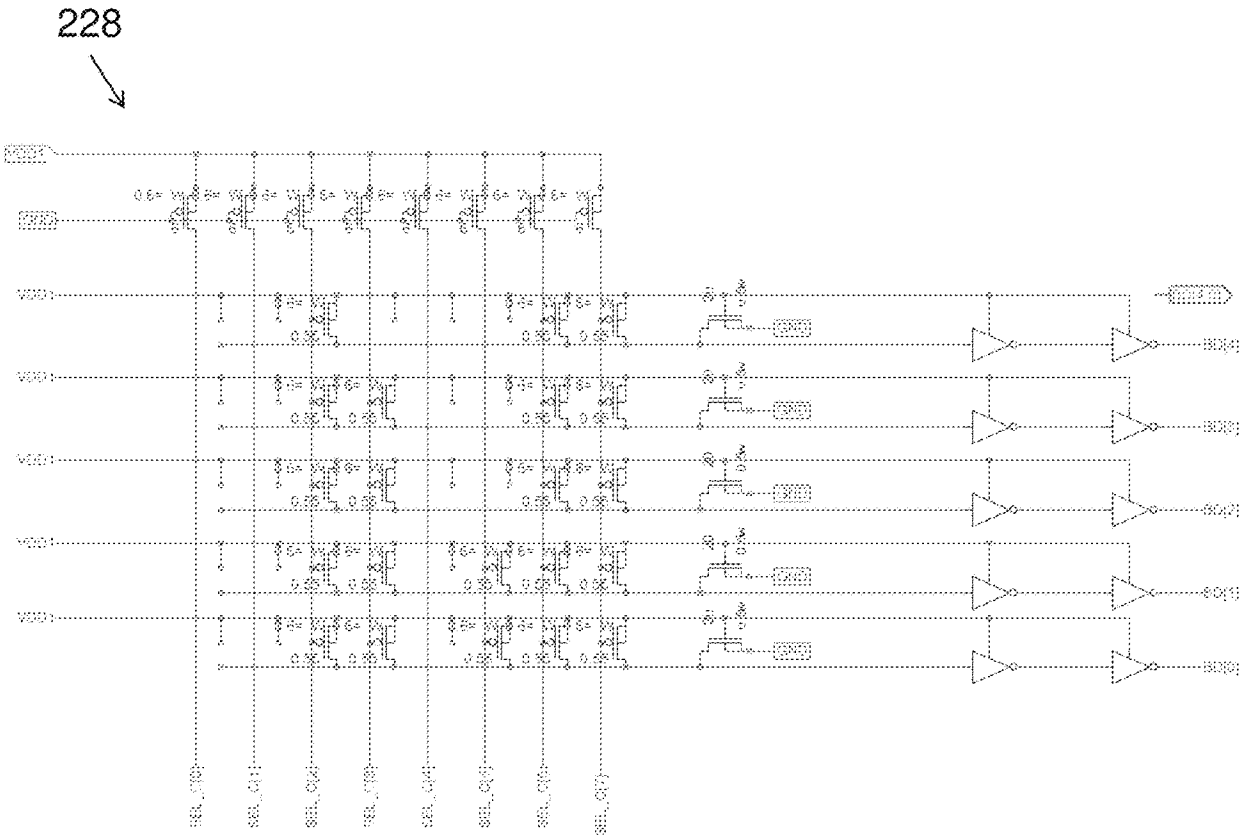
Figure 3H:
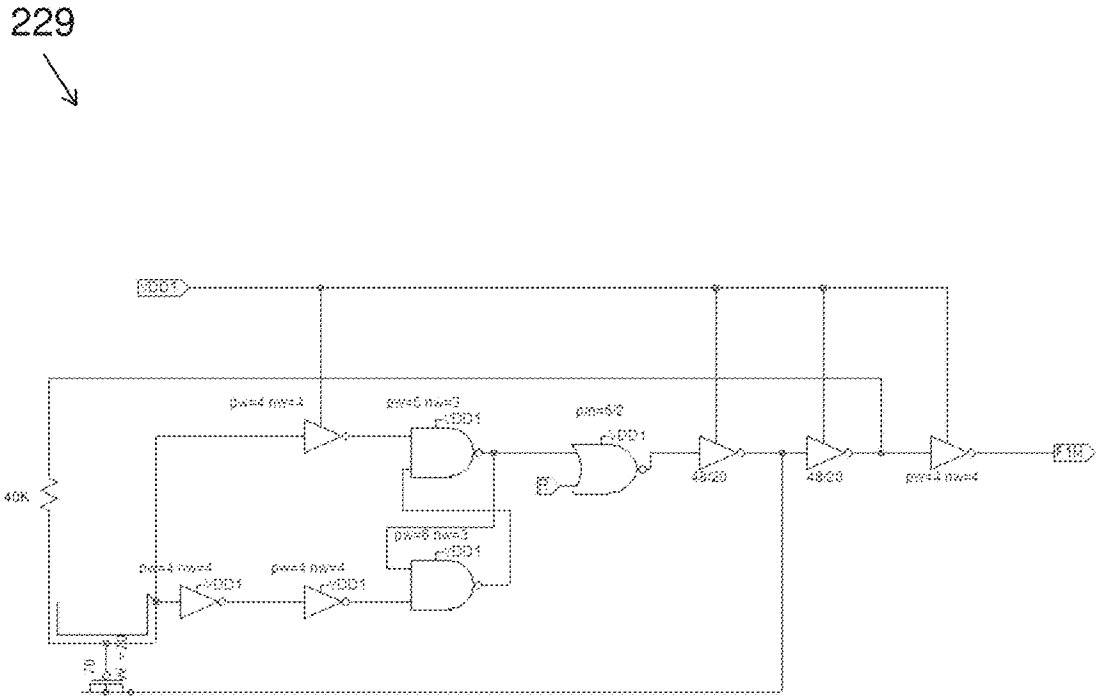
Figure 3I:
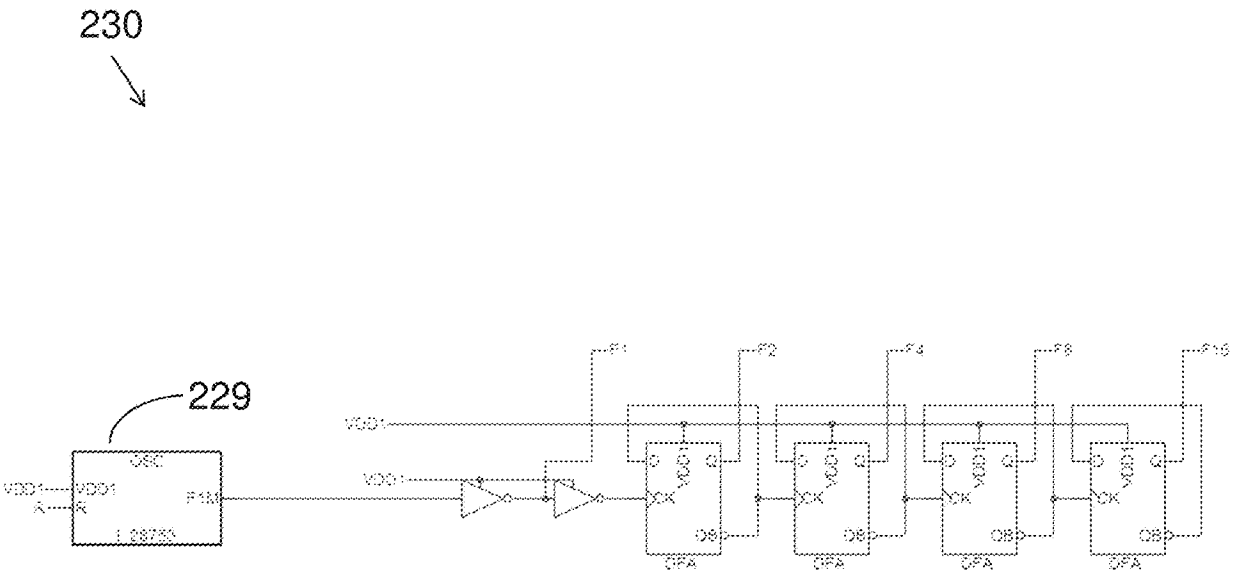
Figure 3K:
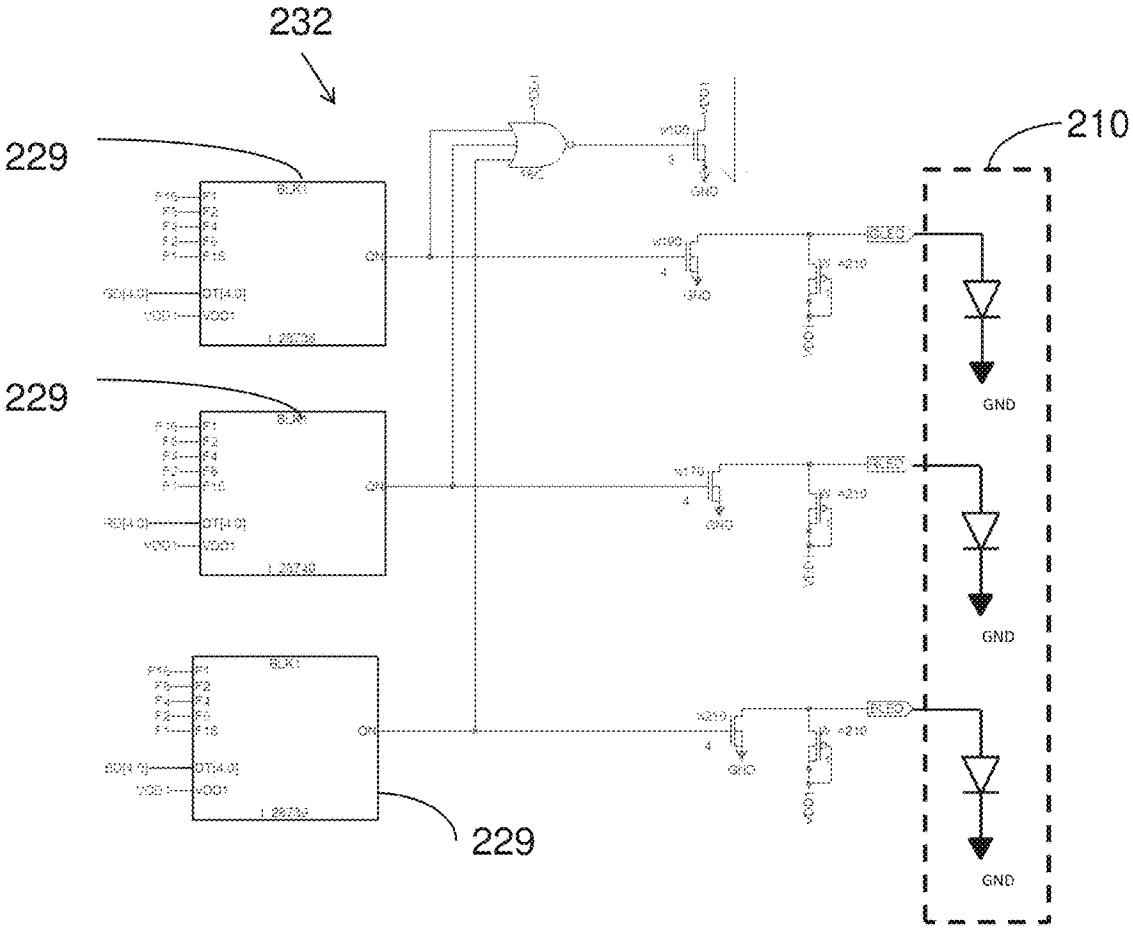
Figure 3L:
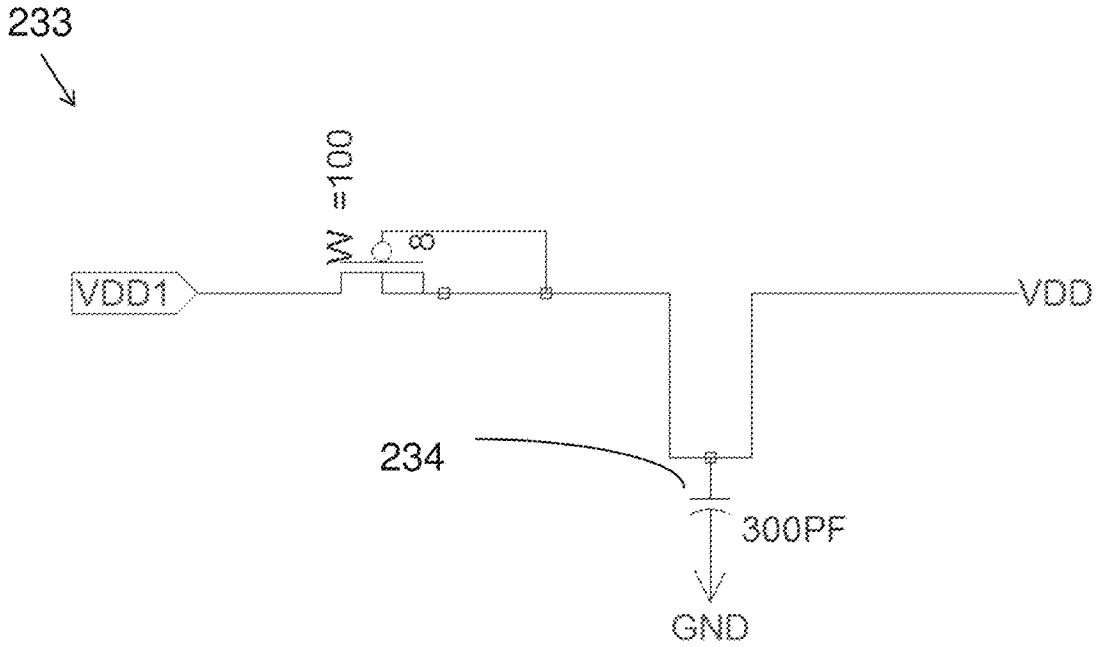

As depicted in FIGS. 3C, 3D, 3E and 3L, the light-source controller 220 may include a voltage regulator 225 to maintain a substantially constant voltage inside the light-source controller 220, independent of voltage variations on the power conductor and the variation of current drawn by the LED(s) to illuminate different colors with different intensities. As depicted in FIG. 3L, the voltage regulator may include a capacitor 234 (e.g., a 300 μF capacitor). The capacitor 234 may supply power (through discharge) to the different components inside the light-source controller 220, as long as a minimum voltage threshold is maintained.

As depicted in FIG. 3F, the light-source controller 220 may include monitoring circuitry 221 suitable to detect power voltage transitions from high-to-low and/or from low-to high. Circuitry 221 may be implemented by a Schmitt trigger. The monitoring circuitry 227 may receive commands (e.g., sequences of switched power) specifying a type of light to be emitted. The commands may be received asynchronously—e.g., they may be received at any time. The monitoring circuitry 226 may also receive reset commands. Reset commands may also be received asynchronously. A reset command may be received during a sequence that specifies a light type. A reset command may cause the light-source controller 220 to return to a default state (e.g., default color and/or effect). A reset command may be longer in duration than other types of power conductor voltage transitions.

According to one technique, different light-source controllers 220 in a given strand may recognize different reset durations. In this way, the light-source controllers 220 may be separately "addressed" by the primary controller 100, such that a given light-source controller 220 may be able to recognize a reset command which is not recognizable by at least one other light-source controller 220 in a strand. One way to achieve selective communication between the primary controller 100 and a given light-source controller 220 is to configure the light-source controllers 220 to recognize different reset period durations As depicted in FIGS. 3A and 3F, the light-source controller 220 may include command-framing circuitry 221, 226, and 227. The command-framing circuitry may latch voltage transitions of the most recently received light-type command/sequence. The circuitry 226 may trigger a reset if the voltage at the input provided by the circuitry 221 is maintained low during a certain number of clock periods (e.g., four clock periods). If a clock has a period of 1 μS, then a reset may occur if the power voltage is maintained low for 4 μS (for example).

According to one technique, different light-source controllers 220 may be configured differently to recognize different reset periods, such that the different light-source controllers can be separately addressed by the primary controller 100. For example, a first light-source controller 220 may recognize a reset when the power voltage is maintained low for 4 clock periods, while a second light-source controller 220 may recognize a reset when the power voltage is maintained low for 5 clock periods. In a given strand (or in different strands), there may be a number of light-source controllers 220 that recognize a first duration period as a reset command and a number of different light-source controllers 220 that recognize a second duration period as a reset command. This technique can be expanded such that it is possible to separately address three or more differently configured light-source controllers 220 in a given strand or in different strands.

After a reset command by the primary controller 100 (or even when no reset command has been issued), the circuitry 227 may add the transitions detected by the circuitry 221. The circuitry may perform the addition using three flip-flops. Based on how many transitions are detected, the circuitry may adjust the outputs (as shown, A0, A0B, A1, A1B, A2, or A2B). If three flip-flops are used, it may be possible to provide 8 different output states (based on 3 bits). The number of possible output states may be increased or decreased by, for example, changing the number of flip-flops that are used.

As depicted in FIGS. 3Ga, 3Gb, 3Gc, and 3Gd, command-interpreting circuitry 228 may be configured to trigger pulse-width modulation circuitry. The command-interpreting circuitry 228 may include a matrix that uses the latched transitions from the command-framing circuitry (see, e.g., FIGS. 3A and 3F) as an input to trigger the right combination of pulse-width modulation signals to drive the lamp(s). The command-interpreting circuitry 228 may be seen as look-up table that may contain predefined combinations of pulse-width modulations for each lamp to obtain any of the light type defined on the product. The latched light type selection is outputted from circuitry 227 and distributed over 8 inputs to the matrix. The state of the inputs may trigger the requested combinations of pulse-width modulations to create the selected light type.

FIG. 3J depicts exemplary pulse-width modulation circuitry 231. A given pulse-width modulation circuitry 231 may combine multiple clock signals. Clock frequencies may vary from the base frequency of an oscillator to the frequency of the oscillator divided 2, 4, 8 and 16, as depicted by the circuitry in FIGS. 3H and 3I (229, 230). For each lamp, a plurality (e.g., 5 as shown) binary outputs (see, e.g., FIG. 3Gd at BD[0]-BD[4]) from the matrix in circuitry 228 may determine the combination of clock frequencies required to create the pulse-with modulation that may feed a lamp as predetermined for a specific light type. The design of the light-source controller 220 may be such that different power/voltage is delivered to different colored LEDs through pulse-width modulation, wherein each of the LEDs may have a different forward voltage drop.

As further shown in FIG. 3K, three LEDs (red, green, and blue) may allow for color mixing to form white light or other color mixing such as purple, yellow, etc. When driven with suitable pulse-width modulation signals, the combination may provide the color and the light effect defined in the light-effect command. The plurality (e.g. 5) of clock frequencies may be inputted to the pulse-width modulators (see, e.g., FIG. 3K at F1, F2, F4, F8 and F16) and among the clock frequencies may be selected according to the binary outputs from the matrix in circuitry 228 that may be inputted to the pulse-with modulator (see, e.g., FIG. 3K at DT[0,4]).

Figure 4:
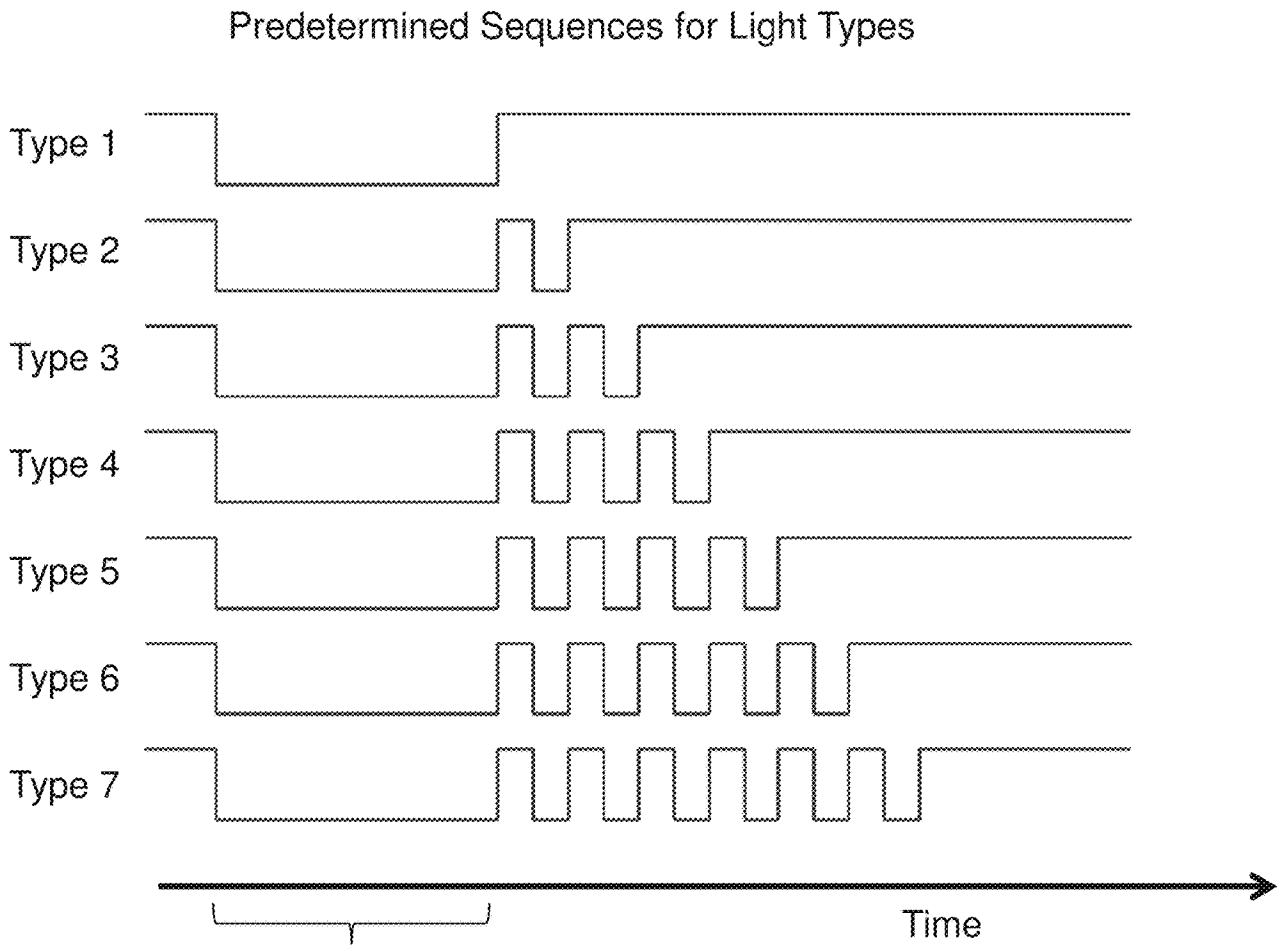
FIG. 4 illustrates timing diagrams for power sequences corresponding to different light types, according to certain inventive techniques.

FIG. 4 depicts example sequences corresponding to various light types. As shown, each sequence varies over time between a high voltage level and a low voltage level. At the beginning of each sequence, there is a reset period of longer duration. This reset period may be detected by circuitry 221 and trigger a reset (see, e.g., FIG. 3F at R1). This may cause the light-source controller 220 to return to a default state corresponding to a predetermined light-type (or no light emitted). Transitions for light type commands may be transferred at 1 MHz. The reset period may be 4 μS or longer. According to one technique, the reset period may be sufficiently fast that the human eye cannot detect any transition of light from the light sources (for example 10 mS or shorter). According to one technique, the light-source controller 220 may be reset to a default state by turning the power low for a duration longer than the power-supplying capacitor 234 can supply operational power to the light-source controller 220.

Following the reset period, the latched light type may be a default light type (by circuit design). Each transition following the reset may move the selection to the next light type of the cycle hardcoded in the matrix of circuitry 228. Since light types may be seen as states in a loop, the distributed units may operate without reset transition before each light type sequence. The reset may ensure that all distributed units 200 are set to the same default light type and none is set to a different light type (for example, due to an undesirable noise event).

As discussed above, according to certain techniques, different light-source controllers 220 may be configured to recognize different durations to be reset periods. This may be one way to create variable colors and/or effects amongst light-source controllers 220 in a given strand or across multiple strands. For example, a first type of light-source controller 220 may recognize a 4 clock period duration with a low voltage on the power conductor as a reset command. A second type of light-source controller 220 may recognize a 5 clock period duration with a low voltage on the power conductor as a reset command. After the 4 clock period reset command, a first type of transition sequence may be driven by the primary controller 100 on the power conductor. The first type of light-source controller 220 may respond to the first type of transition sequence, but not the second type of light-source controller 220. After the 5 clock period reset command, a second type of transition sequence may be driven by the primary controller 100 on the power conductor. The second type of light-source controller 220 may respond to the second type of transition sequence, but not the first type of light-source controller 220. Thus, the light-source controllers 220 may be separately addressed and instructed to cause different types of light types, thereby giving simultaneous variability of light types within a given strand or across multiple strands.

Each rope light strand may have a length between 10 to 15 feet, for example. A number of strands (for example 10-20 strands) may be connected end to end to create a long rope that may reach, for example, 100 feet. Electrically, each strand may be in series to the others. All the distributed units 200 from all the connected strands may receive power from the same primary controller 100.

It will be understood by those skilled in the art that various changes may be made and equivalents may be substituted without departing from the scope of the novel techniques disclosed in this application. In addition, many modifications may be made to adapt a particular situation or material to the teachings of the novel techniques without departing from its scope. Therefore, it is intended that the novel techniques not be limited to the particular techniques disclosed, but that they will include all techniques falling within the scope of the appended claims.

The invention claimed is:

1. An illumination system comprising:

a plurality of distributed units, wherein:

each of the plurality of distributed units comprise a light source and a light-source controller;

the plurality of light sources is configured to simultaneously emit a selected type of light; and the selected type of light comprises one of a first type, a second type, and a third type of light;

a primary controller including:

a voltage converter configured to receive a first voltage and output a second voltage;

power-voltage-delivering circuitry configured to receive the second voltage and deliver a LOW or HIGH power voltage to the plurality of distributed units simultaneously;

an input configured to receive a selection signal corresponding to one of the first type of selected light, the second type of selected light, or the third type of selected light; and power-sequence-controlling circuitry configured to cause the power-voltage-delivering circuitry to automatically transition the power voltage between LOW and HIGH in a first sequence corresponding to the first type of selected light, a second sequence corresponding to the second type of selected light, and a third sequence corresponding to the third type of light, wherein each of the first sequence, the second sequence, and the third sequence is different; and wherein each of the plurality of light-source controllers is configured to:

detect the power voltage provided to the corresponding distributed unit;

cause the corresponding light source to emit the first type of light upon receiving the first sequence;

cause the corresponding light source to emit the second type of light upon receiving the second sequence;

cause the corresponding light source to emit the third type of light upon receiving the third sequence; and cause the corresponding light source continue emitting the first type of light, the second type of light, or the third type of light while the power voltage is HIGH and at a constant voltage.

2. The illumination system of claim 1, wherein the input comprises a wireless receiver.

3. The illumination system of claim 2, further comprising a wireless remote control configured to wirelessly transmit the selection signal to the wireless receiver.

4. The illumination system of claim 1, wherein the selected type of light comprises one of a plurality of predetermined colors.

5. The illumination system of claim 1, wherein the selected type of light comprises a predetermined effect.

6. The illumination system of claim 5, wherein the selected type of light further comprises one of a plurality of predetermined colors.

7. The illumination system of claim 1, wherein the plurality of light-source controllers do not include a processor.

8. The illumination system of claim 7, wherein each of the plurality of light-source controllers further comprise:

monitoring circuitry configured to detect voltage transitions in the power voltage;

command-framing circuitry configured to latch the voltage transitions; and command-interpreting circuitry configured to trigger pulse-width modulation circuitry, wherein the pulse-width modulation circuitry is configured to control the light source.

9. The illumination system of claim 1, wherein each of the plurality of distributed units comprises a capacitor configured to provide an operating voltage to a given light-source controller for a predetermined time when the power voltage is LOW.

10. The illumination system of claim 1, wherein each of the plurality of distributed units is arranged in series.

11. The illumination system of claim 1, wherein each of the plurality of distributed units is arranged in parallel.

12. The illumination system of claim 1, wherein:

the plurality of distributed units is divided into a plurality of segments including a subset of the plurality of distributed units;

each of the plurality of distributed units in the subset is arranged in series with each other; and the plurality of segments is arranged in parallel with each other.

13. The illumination system of claim 1, wherein each of the plurality of light sources includes a plurality of differently-colored light-emitting diodes (LEDs).

14. The illumination system of claim 1, wherein each of the plurality of distributed units comprises a voltage regulator configured to regulate the power voltage to a regulated voltage provided to the respective light-source controller.

15. The illumination system of claim 1, wherein each of the plurality of light-source controllers is configured to use pulse-width modulation to cause the respective light source to emit light of the first type of light, the second type of light, or the third type of light.

16. The illumination system of claim 1, wherein:

the power voltage is LOW for a maximum duration during automatic transitioning; and the maximum duration is sufficiently short such that the human eye cannot perceive that the plurality of light sources have stopped emitting light.

17. The illumination system of claim 16, wherein the maximum duration is less than 10 mS.

18. The illumination system of claim 1, wherein the power voltage comprises a DC voltage.

19. The illumination system of claim 1, wherein the LOW power voltage is substantially zero volts.

* * * * *